US005288032A

United States Patent [19]

Boone et al.

[11] Patent Number: 5,288,032

[45] Date of Patent: Feb. 22, 1994

[54] DISPENSER FOR FLEXIBLE SHEET MATERIAL

[75] Inventors: Bruce T. Boone, Acworth; John S. Formon, Marietta, both of Ga.

[73] Assignee: Georgia-Pacific Corporation, Atlanta, Ga.

[21] Appl. No.: 881,132

[22] Filed: May 11, 1992

Related U.S. Application Data

[63] Continuation-in-part of Ser. No. 751,064, Aug. 28, 1991.

[51] Int. Cl.[5] ..... B65H 16/06; B65H 19/10

[52] U.S. Cl. ..... 242/55.3; 242/55.53

[58] Field of Search ..... 242/55.53, 55.3; 312/34.22

[56] References Cited

U.S. PATENT DOCUMENTS

| | | | |
|---|---|---|---|
| 2,530,429 | 11/1950 | Hedenskoog | 273/47 |
| 3,387,902 | 6/1968 | Perrin et al. | 312/39 |
| 3,589,331 | 8/1971 | Okamura | 242/55.3 |
| 3,690,580 | 9/1972 | Jespersen | 242/55.3 |
| 3,700,181 | 10/1972 | Diring et al. | 242/55.3 |
| 3,770,222 | 11/1973 | Jespersen | 242/55.3 |
| 3,771,739 | 11/1973 | Nelson | 242/55.3 |
| 3,982,619 | 9/1976 | Sieverin et al. | 193/31 |
| 4,137,805 | 2/1979 | DeLuca et al. | 83/345 |
| 4,142,431 | 3/1979 | Jespersen | 83/335 |
| 4,180,183 | 12/1979 | Muller | 221/194 |
| 4,206,858 | 6/1980 | DeLuca et al. | 225/96 |
| 4,222,621 | 9/1980 | Greenlee et al. | 242/55.53 |
| 4,340,195 | 7/1982 | DeLuca | 242/55.3 |
| 4,522,346 | 6/1985 | Jespersen | 242/55.53 X |
| 4,844,361 | 7/1989 | Granger | 242/55.3 |
| 4,856,724 | 8/1989 | Jespersen | 242/55.3 |
| 4,944,466 | 7/1990 | Jespersen | 242/55.3 |
| 5,000,393 | 3/1991 | Madsen | 22/55.3 |

*Primary Examiner*—Daniel P. Stodola
*Assistant Examiner*—John P. Darling
*Attorney, Agent, or Firm*—Banner, Birch, McKie & Beckett

[57] ABSTRACT

A dispenser for flexible sheet material rolls in which a first roll is supported in a dispensing position, a second roll is supported in a reserve position and a roll transfer apparatus is operative to transfer the second roll to the dispensing position upon depletion of sheet material from the first roll with the supporting arrangement for the roll in the dispensing position being rotatable with such roll and thereby subject to significantly reduced friction effects. The described dispenser organization also includes a novel arrangement for retaining the cores and spindles of spent rolls within the dispenser until the closure cover is opened for replenishing the dispenser with fresh rolls whereupon, by opening the cover, the spent residual roll elements are automatically deposited into the opened cover that forms a receptacle from whence the elements can be retrieved for disposal and following which the dispenser organization is automatically returned to its operative condition in a single step upon simply closing the closure cover. In order to retard the fall of a roll to the dispensing position, and thereby avoid injury or unpleasant surprise to a user and reduce noise upon roll transfer, a star wheel may be mounted to be contacted and rotated by a falling roll.

27 Claims, 7 Drawing Sheets

28
40
10
36
16
74
76
18
58
62
14
24
20
32
34
38
58
108
37
12
66
68
54
86
78
77
29
100
98
104
106
50
112
110

DISPENSER FOR FLEXIBLE SHEET MATERIAL

This application is a continuation-in-part of presently pending U.S. application Ser. No. 07/751,064, filed Aug. 28, 1991.

BACKGROUND OF THE INVENTION

This invention relates to dispensers for flexible sheet material, such as toilet tissue, in which a reserve roll is automatically movable from its stored position into a dispensing position upon dissipation of sheet material from the supply roll, and for means for conveniently storing the residual portions of dissipated rolls and their removal upon opening of the dispenser cover.

Flexible sheet material dispenser devices having the capability of moving a reserve roll into a sheet dispensing position upon dissipation of sheet material from the original supply roll, are known. One such example is described in U.S. Pat. No. 3,770,222 granted Nov. 6, 1973 to Paul W. Jespersen and assigned to the assignee hereof. The device shown in this patent, while being relatively simple in design and effective in operation, suffers from certain disadvantages. For example, the patented dispenser organization relies for support of the supply roll upon the wall of the dispenser cabinet thereby increasing to a significant extent the undesirable effects of friction on the operation. Deriving support of the supply roll by its continual contact with the cabinet wall not only adds to the amount of force required to be imparted by a user in withdrawing sheet material from the dispenser, it also creates the danger of damage to the delicate sheet material being dispensed caused by the erosive effects of the material rubbing against the wall surface as the supply roll rotates during the withdrawal of sheet material.

Another deleterious characteristic of prior art devices of the concerned type is that, commonly, the residual elements of the spent supply rolls, namely the core and spindle end caps therefor, are discharged by simply being permitted to fall from the open bottom of the dispenser and thus become an eyesore to the environs of the dispenser. Where the problem has been addressed, the solutions proposed involving closing the bottom of the dispenser to form a collection compartment is less than totally satisfactory due to the problem of gaining access to the elements for ultimate disposal.

It is to the amelioration of the above problems, therefore, to which the present invention is directed.

Prior art dispensers such as disclosed in aforementioned U.S. Pat. No. 3,770,222 are also arranged such that the fall of a reserve roll to the dispensing position is broken at a position well within the dispenser, out of hands reach, so that a user whose hand happens to be inserted into the dispensing opening does not experience injury or unpleasant surprise due to the impact of a falling reserve roll at the time of roll replacement. This leads to the need for a depth dimension of the dispenser which is substantially greater than the diameter of the rolls of sheet material. Accordingly, a larger space must be allocated for the dispenser. Furthermore, such prior art arrangements do little to alleviate the potentially disturbing noise caused by the sudden impact of a falling roll within the dispenser.

Accordingly, there is a need for a dispenser design that avoids the above-described potential problems associated with the impact of a reserve roll falling to a dispensing position, without requiring a dispenser depth dimension substantially greater than the roll diameter.

SUMMARY OF THE INVENTION

In view of the foregoing it is a principal object of the present invention to provide an improved dispenser for flexible sheet material rolls.

It is also an object of the invention to provide an improved, less friction-sensitive sheet material dispenser of the type in which a reserve roll is automatically transferred to the dispensing position upon depletion of the original supply roll.

It is a further object of the invention to provide a dispenser of the described type in which the residual cores and spindles from depleted rolls can be stored within the dispenser and conveniently released therefrom for retrieval upon opening the dispenser cover to replenish the roll supply.

It is a still further object of the present invention to provide a dispenser arranged to avoid injury or unpleasant surprise to a user due to the impact of a reserve roll falling into a dispensing position, while at the same time avoiding the requirement of a depth dimension of the dispenser substantially greater than the roll diameter.

It is yet another object of the present invention to provide an arrangement whereby the impact of a reserve roll falling into a dispensing position is substantially reduced, whereby a concomitant reduction in the amount a noise of automatic roll replacement is realized.

Therefore, there is provided according to one aspect of the invention a dispenser for a plurality of dispensing rolls of flexible sheet material comprising a chassis; a dispensing roll transfer structure including means forming opposed guide channels on opposite sides of said chassis operative to receive the axial ends of a first dispensing roll in a sheet-dispensing position and a second dispensing roll in a reserve position thereabove, both said dispensing rolls being movable downwardly in said guide channels by gravity; a dispensing roll support extending between opposite sides of said chassis for vertically supporting a dispensing roll in its sheet-dispensing position; said guide channel-forming means including a guide track member mounted for pivotal movement between a support position for vertically supporting said second roll when said first roll is in a sheet-dispensing condition and a release position in which said second roll is released for movement to said paper-dispensing position when said first dispensing roll is in a depleted condition.

Support provided for the sheet dispensing roll in its dispensing position is derived from a rotatable gauging roll which is effective to reduce the friction effects caused by the roll-support device and which is formed with a surface projection that acts on the roll as it rotates so as to relieve the problem of looping of the sheet material which is attendant to dispensers of the concerned type.

Furthermore, the guide channels formed by the cooperation between the fixed and the movable guide track members are so arranged as to automatically induce movement of the dispensing roll in the direction of the dispenser opening as the diameter of the roll is diminished in order to facilitate user access to the leading end of the material.

According to another aspect of the present invention there is provided a dispenser for sheet material wound on dispensing rolls having residual elements and incorporating means for disposal of such elements following dissipation of said sheet material from said rolls, said dispenser comprising a chassis having a dispensing roll transfer structure from which residual elements of dissipated dispensing rolls are discharged, when spent; means forming a compartment in the bottom of said chassis for receiving said residual roll elements; a door operably connected to said chassis for releasably closing said compartment; a cover pivotally attached to said chassis for movement between an open and a closed position thereon; releasable latch means for holding said door in its compartment-closing condition; and means for automatically releasing said latch means for opening said door upon moving said cover to its open position.

Automatic release of the compartment-closing door is afforded by the cooperative relative dispositions of the pivotally mounted door and dispenser cover whereby the cover, in pivoting to its open position, as for example for replenishing the dispensing rolls therein, is caused to so engage the door as to effect the release of the latching mechanism whereupon the door is caused to open and discharge the residual roll core and spindle elements from the compartment.

Moreover, due to the rectangular box-like shape assumed by the dispenser cover in its inverted condition when opened, the residual roll elements in dropping from the opening door are readily received in the cover from whence they can be retrieved for disposal.

Also, the dispenser cover is configured and arranged with respect to the door as to automatically effect closure and relatching of the door when the cover is returned to its closed condition.

In yet another aspect, the present invention provides a dispenser for dispensing sheet material from a first roll and retaining therein at least one reserve roll from which sheet material may be dispensed when the first roll is depleted. The dispenser comprises a chassis and a dispensing roll transfer means attached to the chassis for transferring a roll to a dispensing position. The transfer means includes guiding means for guiding the roll along a pathway to the dispensing position as it falls under the force of gravity, and fall retarding means positioned in the pathway for retarding the fall of the roll. Preferably, the fall retarding means comprises a rotatable member positioned to be contacted and rotated by the roll falling along the pathway, whereby the fall of the roll is retarded by rotational resistance of the rotatable member. Rotation of the rotatable member may be dampened by a high-shear motion control grease applied to a rotatable coupling connecting the rotatable member to the chassis, and the rotatable member may take the form of a star-wheel having a plurality of substantially radially extending spokes.

These and other objects and features of the invention will be apparent upon consideration of the following detailed description of preferred embodiments thereof presented in connection with the following drawings in which like reference numerals identify like elements throughout.

DETAILED DESCRIPTION OF THE PREFERRED EMBODIMENTS

Figure 1:
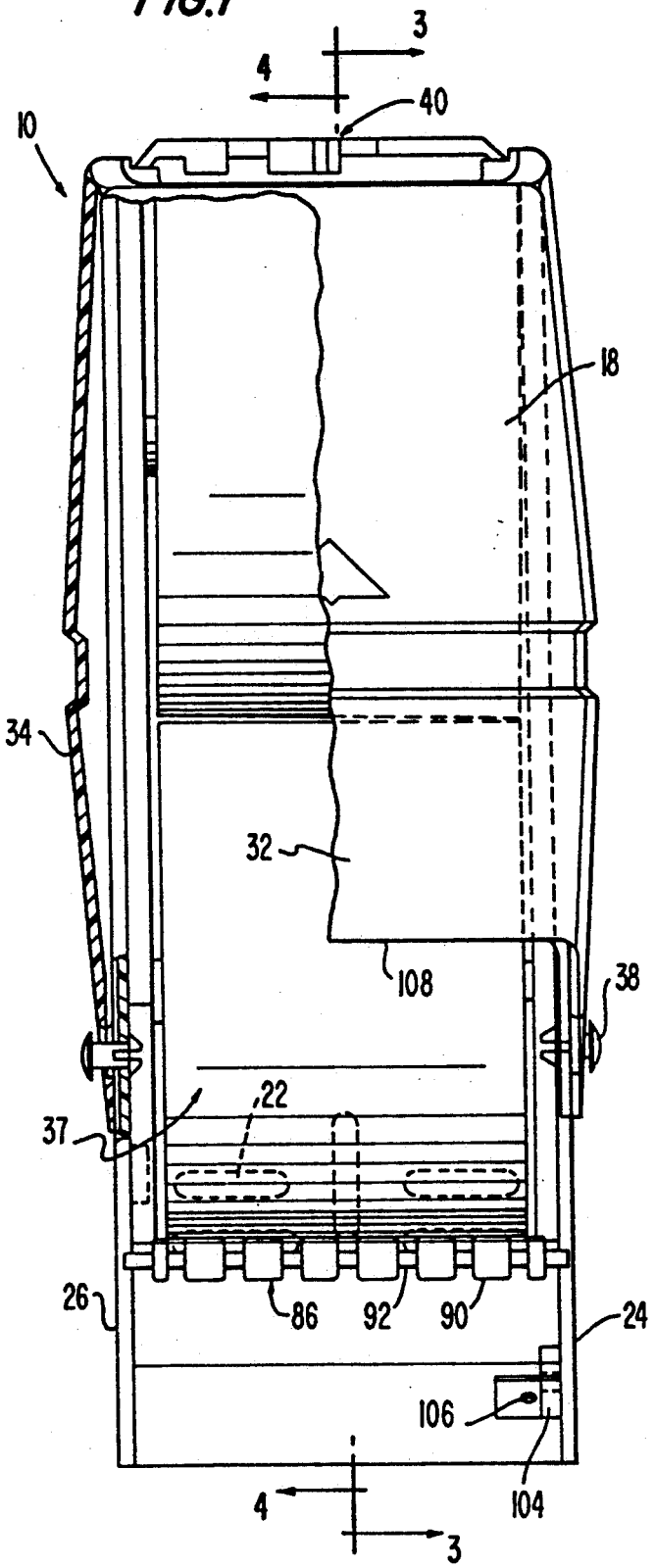
FIG. 1 is a front elevational partial view of a dispenser for flexible sheet material constructed according to the present invention.

The drawings illustrate a dispenser, indicated generally by the reference numeral 10, for flexible sheet material that is wound on dispensing rolls, here designated, for the sake of description, as supply roll 12 and reserve roll 14.

Dispenser 10 is formed principally of molded plastic construction and includes a cabinet structure formed by a chassis 16 and a closure cover 18. Chassis 16 comprises a back wall 20 containing appropriately positioned mounting holes 22 (only two of which are depicted in the drawing figures) for attaching the dispenser to an upstanding building structure and oppositely spaced side walls 24 and 26 projecting forwardly from the back wall. The top of the chassis 16 contains a forwardly projecting support element 28 interconnecting the upper ends of the back wall 20 and side walls 24 and 26 and a brace 29 extends between and laterally supports the side walls adjacent the chassis lower end.

The interior of the dispenser 10 is closed by the closure cover 18 having generally rectangularly disposed front, side and top walls 32, 34 and 36, respectively. The back and bottom ends of the cover are open. As shown, the lower end of the respective cover walls are spaced from the bottom of the chassis 16 to define a sheet dispensing opening 37 to enable access by a user of the leading end of flexible sheet material from a dispensing roll, such as the supply roll 12 when in its dispensing position. The cover 18 is connected by pivot pins 38 that extend through openings formed at the back of the lower ends of the cover side walls 34 and that attach to the respective side walls 24 and 26 of the chassis 16 so that the cover can be rotated between a closed position, as presented by the solid line illustration in FIG. 4, and an angularly displaced open position, as depicted by the dash lines in the drawing figure.

A releasable locking mechanism 40, of generally well known construction, is provided for locking the cover 18 in its closed condition to the chassis 16. It includes a fixed latch element 42 integrally formed on the support element 28 and a movable metal plate 44 cooperable therewith and pivotally secured to a metal mounting plate 35 at the top end of the cover to form the cover top wall 36 for operation by a key 46, or the like. It will be appreciated that when the cover is closed and its top wall 36 snugly received over the chassis support element 28, a hook-like latch member 48 formed on the plate 44 is caused by a spring bias on the plate to be placed in locking engagement with a cooperating latch member 42 integrally formed on the support element 28.

At the bottom end of the chassis 16 there is formed a compartment 78 that is closed by a pivotally mounted closure door, indicated generally at 50, the structure and function of which are described in detail hereinafter.

Figure 5:
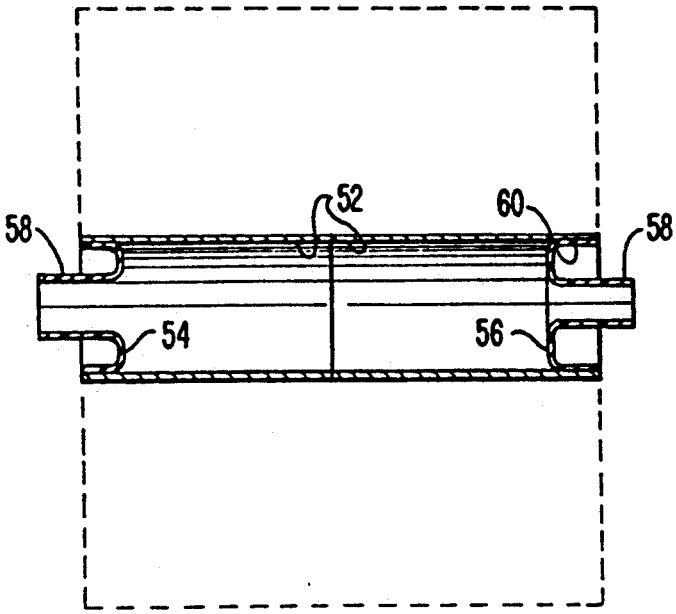
FIG. 5 is a sectional elevational view of a dispensing roll for use with the dispenser of FIG. 1.

Dispenser 10 is adapted to dispense flexible sheet material, as for example, toilet tissue or the like, from dispensing rolls, such as those shown at 12 and 14 in the drawing figures. As shown best in FIG. 5, the rolls 12, 14 each include a hollow, split cylindrical cardboard core formed by core segments 52 about which the sheet material is wound. A spindle means is formed by trunnions 54 and 56 that extend axially outwardly from the respective core segments 52. The trunnions, which are formed of a plastic material, each comprise an axial shaft portion 58 adapted to cooperate with guide channels 62 and 64, hereinafter described, and a retaining flange 60 adapted for friction retention of the spindles in the core segments 52.

The dispenser 10 contains a dispensing roll transfer structure that comprises generally vertically elongated, oppositely facing, open ended guide channels 62 and 64 formed on the respective side walls 24 and 26 of chassis 16 and adapted to receive the axially extending shaft portions 58 of the trunnions 54 and 56 of the supply and reserve rolls 12 and 14. Each of the guide channels 62 and 64 are formed by track members that are mutually spaced to receive the trunnion shaft portions for guided movement of the respective dispensing rolls 12 and 14, as hereinafter described. Guide channel 62 on side wall 24 is shown as being formed of a pair of integrally formed, fixed guide track members 66 and 68 and adapted to guidingly receive the smaller diameter shaft portions of trunnions 54 of the respective rolls. Guide channel 64 on side wall 26 which receives the larger diameter shaft portion of trunnions 56, on the other hand, is formed by a forwardly positioned, integrally formed, fixed guide track member 70 that cooperates with a movable guide track member 72 that operates as a roll transfer lever.

The openings 74 at the upper ends of the respective guide channels 62 and 64 are caused to diverge by the inclusion on the forward-most track members 68 and 70 of the respective guide channels 62 and 64 of the divergent flange portions 76 to facilitate loading of dispensing rolls into the roll transfer structure. Openings 77 at the bottom end of the guide channels 62 and 64 are positioned to discharge the residual roll elements which include the core 52 and trunnions 54, 56 of spent rolls into a compartment region, indicated as 78, in the dispenser bottom.

The movable track member, or transfer lever 72, is mounted to the chassis side wall 26 by a pivot pin 80 that permits front-to-rear pivotal movement of the member. A motion stop 82 comprising an integrally formed projection from the side wall 26 serves to limit the extent of movement of the transfer lever 72 in a counter-clockwise direction. The pivot pin 80 is preferably located in an off-center position along the length of the transfer lever 72 to impart thereto a normal counter-clockwise bias disposing the lever lower end of the lever against the stop 82.

The upper end 84 of the transfer lever 72 is adapted to engage and vertically support the spindle shaft 58 of the trunnion 56 of the dispensing roll 14 in the reserve position. As shown, the end of the lever 72 is formed as a downwardly inclined arcuate surface 83 in order to enable the engaged trunnion shaft to urge the lever clockwise to displace its upper end rearwardly when the lever is free to pivot.

Figure 2:
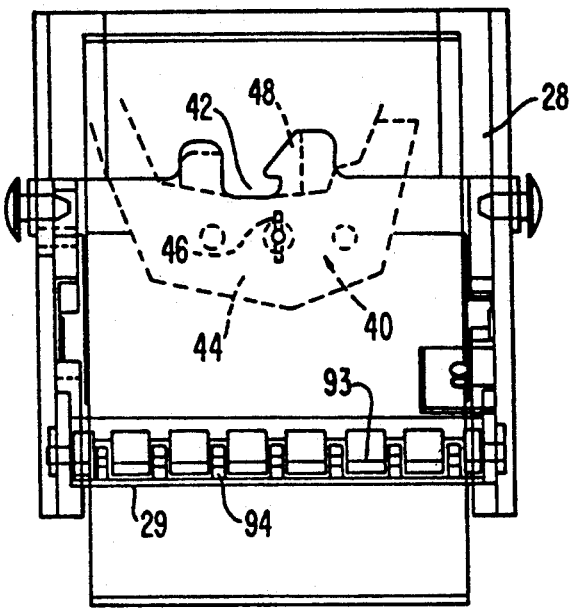
FIG. 2 is a top plan view of the dispenser of FIG. 1 shown with the closure cover removed.
Figure 4:
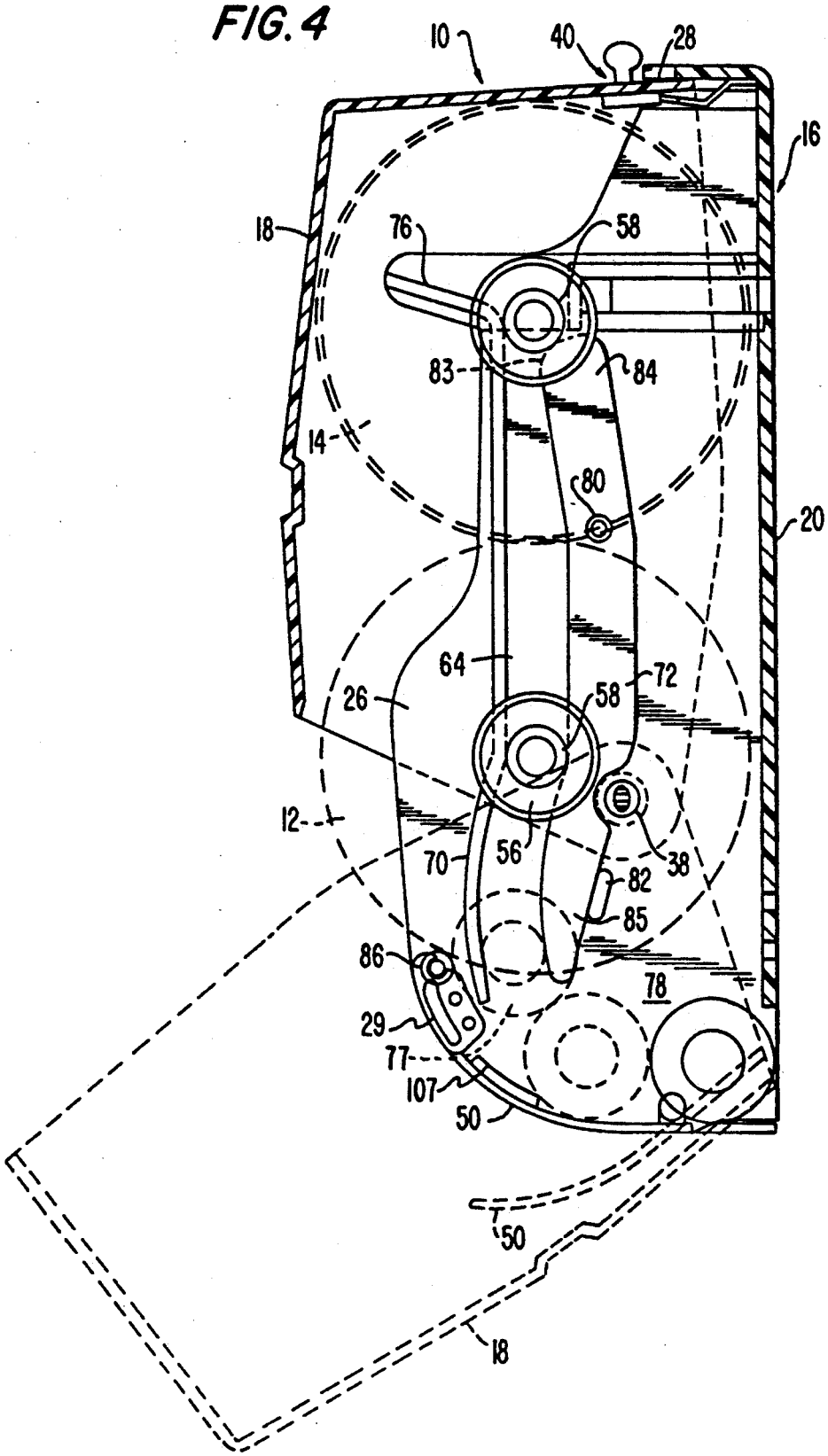
FIG. 4 is a side sectional elevation view taken along line 4—4 of FIG. 1.

A roll-support member is provided to vertically support the supply roll 12. Such member is in the form of gauging roll 86 that extends transversely of the chassis 16 between journal mounts 88 (FIG. 6) formed in the respective side walls by means of which the gauging roll is permitted to rotate. As shown in FIGS. 1 and 4 the gauging roll 86 is formed of alternating large diameter portions 90 and small diameter portions 92. The surfaces of the large diameter portions 90, which engage the supply roll 12 when in its dispensing position, have formed thereon radial projections 93 that serve to intermittently displace, or bounce, the roll when sheet material is being dispensed therefrom by a user. in this way, any looping or sag as may occur in the outer winding of sheet material on the dispensing roll adjacent the gauging roll can be taken up by tension applied to the sheet material by the user when the dispensing roll is intermittently out of contact with the gauging roll. Preferably, stripper arms 94 (FIG. 2) extend from the interior surface of the brace 29 into the spaces created by the small diameter portions 92 of the gauging roll 86 so as to prevent adherence of the free end of the sheet material on the dispensing roll to the adjacent winding.

To load the dispenser, closure cover 18 is opened and the shaft portions 58 of trunnions 54 and 56 of the flexible sheet dispensing roll, identified as supply roll 12, are inserted into the upper ends 74 of the respective guide channels 62 and 64. It will be appreciated that, because the width of the respective guide channels 62 and 64 correspond to the diameters of the respective trunnion shaft portions, all of the rolls will be installed in the dispenser uniformly with the sheet material winding occuring identically on each roll, thus to insure the extension of the leading end of the material from all rolls from the sheet dispensing opening 37 for access by a user.

The dispensing roll 12 gravitates downwardly along the guide channels 62 and 64 until the outer peripheral surface formed by the wound material thereon engages the gauging roll 86 whereby the roll is disposed in its sheet dispensing position. With the roll 12 in this position, its spindle shaft 58 on trunnion 56 is caused to engage the adjacent edge of the lower end 85 transfer lever 72 to urge this end of the lever counter-clockwise against the stop 82. With the lever lower end 85 disposed against the stop 82 the upper end 84 is moved to a position that obstructs the upper end of guide channel 64. Consequently, when placed in the dispenser 10, the reserve roll 14 is retained with the spindle shafts 58 of its trunnions 54 and 56 held at the upper ends of the respective guide channels 62 and 64 due to the supported engagement of trunnion 56 by the upper end surface 83 of the transfer lever 72.

As sheet material is consumed from supply roll 12, the spindle shafts 58 on trunnions 54 and 56 on this roll move downwardly along the respective guide channels 62 and 64 with the periphery of the roll being continually supported by the gauging roll 86. Due to the forwardly curved configuration of the respective guide channels 62 and 64 adjacent the lower ends of the channels, the supply roll 12, as sheet material is dispensed therefrom, is displaced toward the dispensing opening 37 thus to continually maintain the free end of the sheet material externally of the dispensing opening and within easy access by a user.

The relative dimensions and positioning of the gauging roll 86 and facing edge of the lower end 85 of transfer lever 72 is such that, for so long as sheet material remains on the core 52 of the supply roll 12, the spindle shaft 58 on the trunnion 56 thereof is caused to urge the transfer lever 72 against the stop 82 and, concomitantly, the upper end 84 of the transfer lever in supporting and obstructing engagement with the spindle shaft 58 of the reserve roll trunnion 56. Upon depletion of sheet material from the supply roll 12, the residual elements thereof; namely, core segments 52 with the retained trunnions 54 and 56, are free to fall by gravity from the open lower ends of the guide channels 62 and 64 and into the compartment 78 formed at the bottom of the chassis. Passing on the residual roll elements from the guide channels, and particularly of the spindle shaft 58 of trunnion 56 from between the gauging roll 86 and forward edge of the lower end of the transfer lever 72, leaves the lower end of the guide channel 64 free to accept the inward or clockwise movement of the transfer lever lower end. Therefore, due to the action of the spindle shaft 58 of the reserve roll trunnion 56 on the inclined end surface 84 of the upper end of the transfer lever 72, the lever is caused to pivot clockwise so that the upper end is moved from its channel-obstructing position, and the reserve roll 14 accordingly falls by gravity to the sheet dispensing position originally filled by the supply roll 12 and dispensing of sheet material by a user.

According to the other aspect of the invention, the bottom of the chassis 16 is formed with a releasable door 50 which retains the residual elements, such as core segments 52 and trunnions 54 and 56 from the dissipated roll or rolls that fall from the guide channels 62 and 64 into the compartment 78. The door 50 is formed by a contoured plate 98 formed of plastic material that extends transversely across the width of the chassis 16 between the side walls 24 and 26 thereof. The door plate 98 is pivoted about a horizontal axis by means of pivot pins 100 integrally formed on the upper surface of the plate intermediate the forward and rearward ends thereof. Pins 100 are journalled for pivotal movement in bearing mounts 102 formed in the respective side walls 24 and 26.

The door plate 98 is held in its closed position by a releasable latching device that is preferably formed by a magnet member 104 fixed to the inner surface of side wall 24 for cooperation with a magnetically-responsive metal plate 106 that is fixedly secured to the interior surface of the door plate 98. The opposite lateral end of the door plate is positioned by means of a stop 107 integrally formed on the chassis side wall 26.

The door 50 is adapted to be opened automatically upon opening of the closure cover 18 and, conversely, to be closed automatically upon returning the cover to its closed position. Thus, with particular reference to FIG. 3, it is apparent that, when the dispenser closure cover 18 is pivotally moved to its open position, the lower end, indicated as 108, of the cover front wall 32 is caused to engage the door plate 98 rearwardly of the pivot pins 100 whereby the front end of the door plate carrying metal plate 106 is moved sufficiently away from the magnet member 104 to release the attraction between the magnet and the metal plate. When this magnetic connection is broken, the door plate 98 is free to rotate by gravity in a clockwise direction under the unbalanced weight of the door plate and, particularly, as the unbalanced weight is supplemented by any residual roll elements that may be housed in the compartment 78 resting on the interior surface of the door plate.

Figure 3:
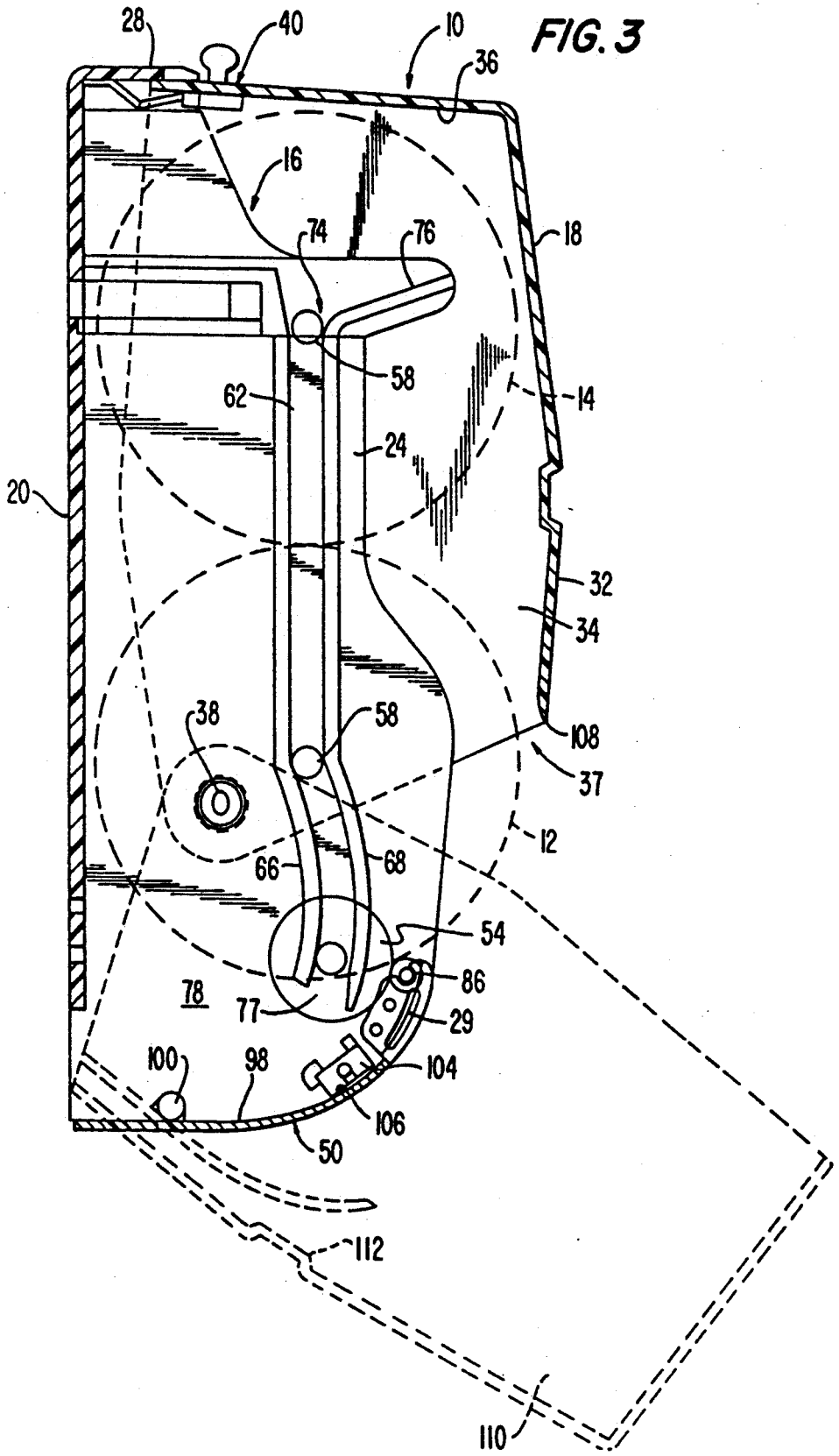
FIG. 3 is a side sectional elevation view taken along line 3—3 of FIG. 1 and showing the closure cover and compartment door in their closed and open conditions.

As best shown by the phantom line representations in FIG. 3, the closure cover 18, in its inverted open condition disposes the rectangularly arranged front, side and top walls, 32 to 36, to conveniently form a receptacle 110 into which any residual roll elements discharged from compartment 78 through the opened door 50 will fall and from whence they can be readily retrieved for disposal.

Advantageously, as indicated above, the door 50 is returned to its closed, latched condition upon closure of the cover 18 by the wiping action imposed on the facing surface of the door plate 98 by the cover lower end 112. Thus, as the cover 18 is angularly displaced counterclockwise toward its closed condition, the end 112 wipingly engages the door plate 98 forwardly of the pivot pins 100 to urge it in a counterclockwise direction to a point that the metal actuating plate 106 is placed sufficiently close to the magnet 104 to be magnetically latched thereby.

Accordingly, it will be appreciated that the present invention provides a dispenser for flexible sheet material that is simple in design and inexpensive in cost, as compared with similar apparatus known in the prior art. Moreover, the herein-described dispenser is advantageously capable of providing a substantially friction-free delivery of sheet material from the supply roll without any cost to the effectiveness or ability of a reserve roll to be transferred to the dispensing position upon depletion of material from the supply roll.

Also, the invention further provides an effective manner of retaining the residual portions of spent rolls within the dispenser until the closure cover is opened, as, for example, to replenish the dispenser with fresh rolls. As a result of the relative organization of the dispenser compartment door and the closure cover, a workman, by simply opening the closure cover can automatically release such residual portions from the dispenser compartment into a receptacle formed by the closure cover whereby they can be readily retrieved for disposal. Conversely, return of the dispenser organization to its operative condition is automatically achieved in one step by the workman's simply closing the cover after replenishing the dispenser with fresh rolls.

Figure 6:
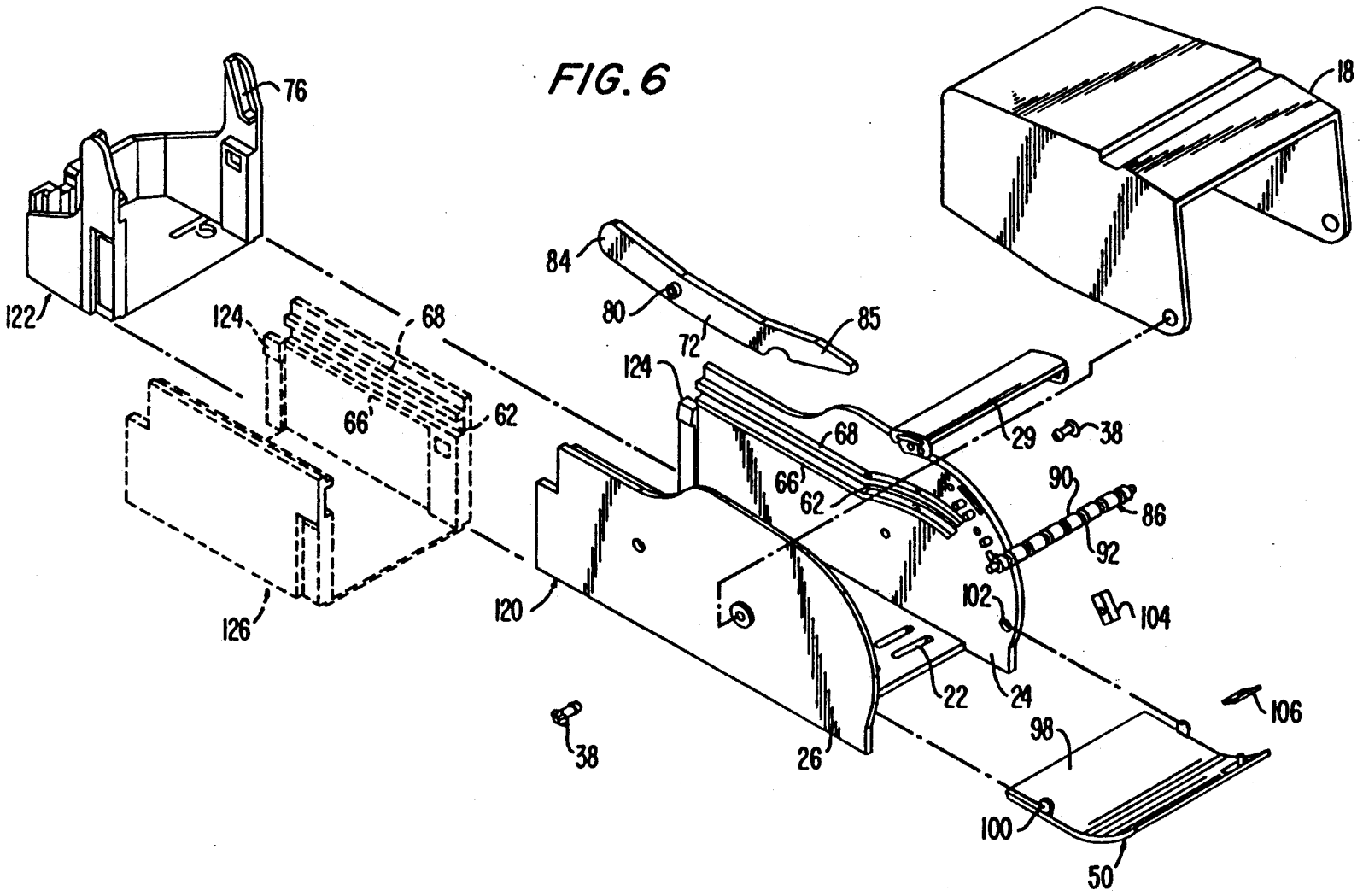
FIG. 6 is an exploded, perspective view of the dispenser of FIG. 1.

Furthermore, the described apparatus design readily lends itself to expansion into a dispenser for holding two flexible sheet material dispensing rolls in reserve while one roll is disposed in the dispensing position. Thus, as shown in FIG. 6, the above-described chassis 16 can be formed by a main chassis segment 120 and a top segment 122 that are interconnected by aggressive snap-fit connections 124, of known design. Alternatively, to impart to the dispenser 10 the capability of holding an additional dispensing roll in reserve there need be added only the structure, termed the middle adapter, shown in phantom at 126 in FIG. 6 that is arranged for locked installation by similar snap fit connections 124 having the same configuration as the corresponding segments used for a two roll installation intermediate the main chassis segment 120 and top segment 122. Beyond this, the only other change required is the use of a closure cover 18 having an increased length sufficient to accommodate the interposition of the middle adapter 126 between the main chassis and top segments 120 and 122 respectively.

A modified version of the dispenser of FIGS. 1–6 is now described with reference to FIGS. 7–9.

Figure 7:
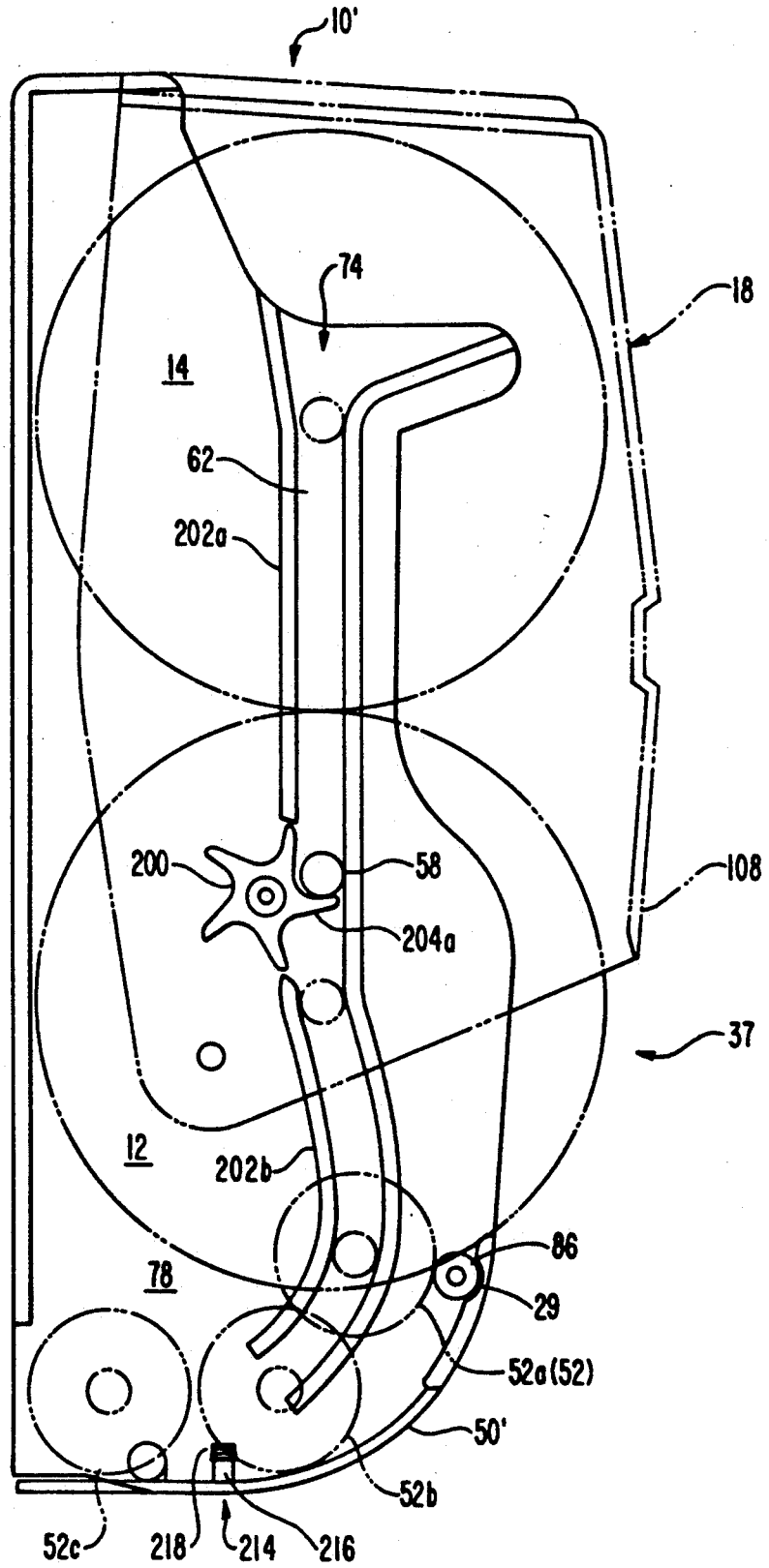
FIG. 7 is a cross-sectional view similar to FIG. 3, showing a modified version of the dispenser illustrated in FIGS. 1–6.

Referring first to FIG. 7, illustrated in a cross-sectional view similar to FIG. 3 is a modified dispenser 10' that differs from dispenser 10 primarily by the inclusion in the former of a rotational member (star wheel) 200 for slowing the fall of a roll of sheet material to a dispensing position. Both during the initial loading of the dispenser and upon automatic roll transfer, a roll of sheet material (e.g., 12,14) will fall downwardly along a pathway defined between guide channels 62 and 64 from a top (reserve) position adjacent divergent openings 74 to the dispensing position wherein the outer circumference of the roll rests against gauging roll 86. If a user's finger happens to be positioned within sheet dispensing opening 37 in the vicinity of brace 29 and gauging roll 86 during roll loading or automatic transfer, there is the potential for the falling roll to impact upon the user's finger. Such impact could cause injury or unpleasant surprise. Furthermore, the impact of a rapidly falling roll of sheet material against gauging roll 86 causes noise which potentially could be disturbing or annoying to a user. Star wheel 200 solves these potential problems (as hereinafter described), without requiring an increased depth dimension of the dispenser.

In place of single piece track member 66 of the first embodiment, provided is an interrupted track member comprising upper and lower guide track segments 202*a* and 202*b*. Star wheel 200 is configured and rotatably mounted between upper and lower guide track segments 202*a* and 202*b* such that, regardless of its angular position, one spoke (e.g., 204*a*) of a plurality of substantially radially extending spokes 204 thereof will protrude sufficiently into guide channel 62 to allow the trunnion shaft portion 58 of a falling roll to contact and rotate star wheel 200 as it passes the same. Due to rotational resistance provided by means hereinafter described, star wheel 200 will rotate slowly to an appropriate reset position, and the fall of a roll to the dispensing position will be retarded or slowed sufficiently to avoid any danger or unpleasant surprise to a user. Furthermore, a concomitant reduction in the amount of noise caused by the impact of a falling roll against gauging roll 86 will be realized. To ensure that a falling roll does not regain substantial speed after passing star wheel 200, star wheel 200 should be positioned such that the falling roll is no more than ½ inch above gauging roll 86 when it just passes star wheel 200.

An added benefit of star wheel 200 is that it allows extra time for a depleted roll core 52 to enter storage compartment 78. Absent star wheel 200, there is a possibility that during roll transfer a depleted core 52 would open releasable door 50' because it is hit by a falling full roll 12 while still in position 52*a* and slammed against the inside of door 50' at position 52*b*. By retarding the fall of a roll being transferred to the dispensing position, star wheel 200 allows a spent core to go to position 52*c* before the falling roll reaches the bottom of its travel, and inadvertent opening of door 50' is thereby avoided.

Figure 8:
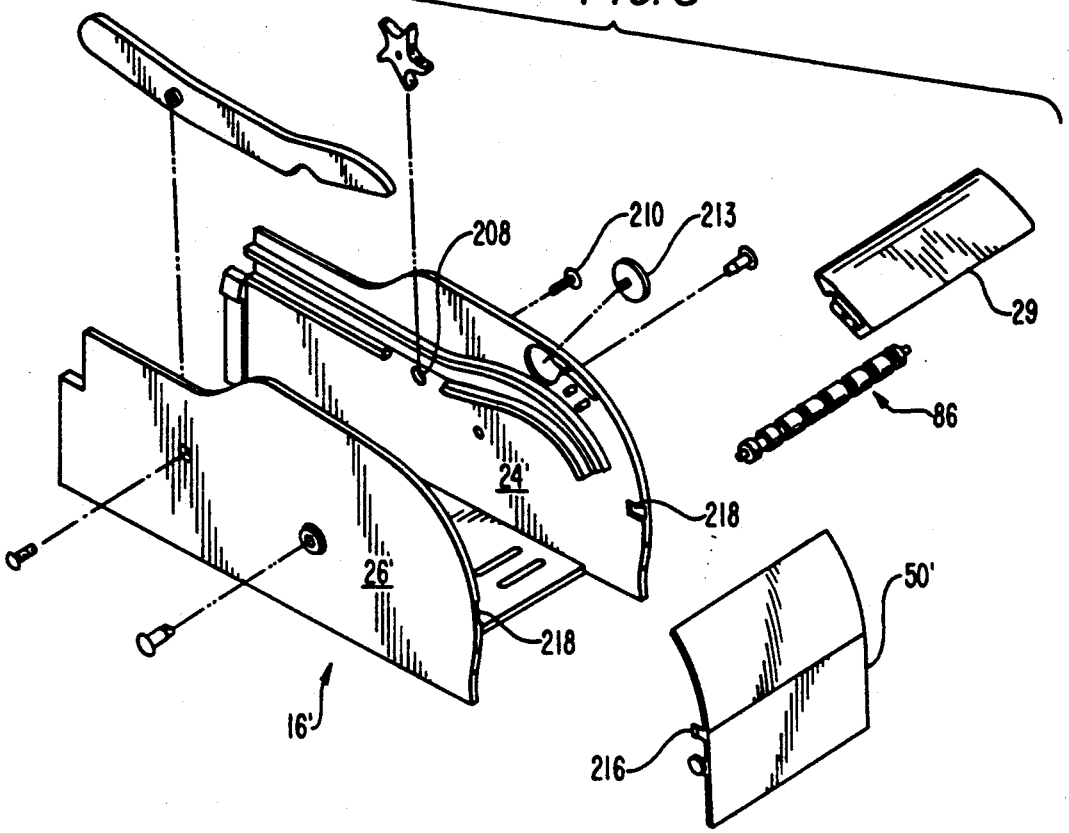
FIG. 8 is a partial exploded view of the modified dispenser embodiment of FIG. 7.
Figure 9:
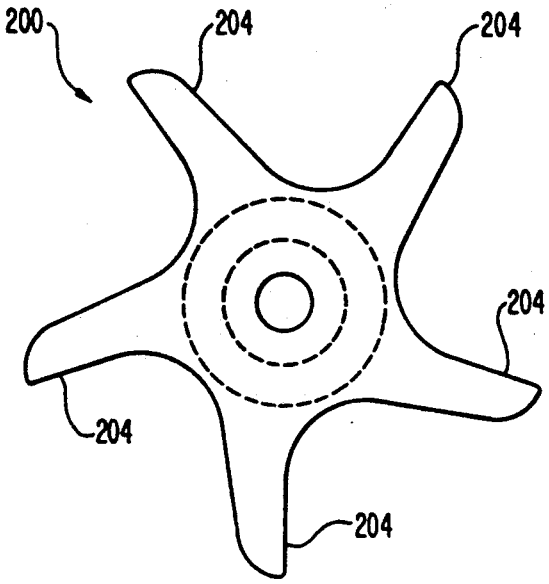
FIG. 9 is a front elevational view of a star wheel serving to retard the fall of a roll to a dispensing position in the modified dispenser embodiment.
Figure 10:
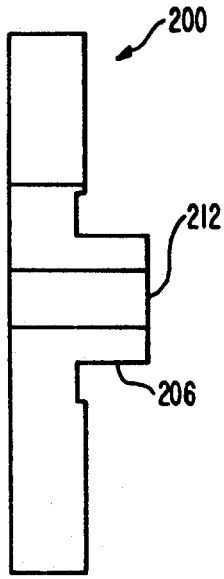
FIG. 10 is a side elevational view of the star wheel of FIG. 9.

Referring now to FIGS. 8 and 9, Star wheel 200 is preferably formed of molded plastic with five substantially radially extending spokes or arms 204 and a shaft 206 which is rotatably secured in a correspondingly sized aperture 208 provided in side wall 24' of chassis 16' by a screw 210. Screw 210 is sized to be threaded into a cylindrical bore 212 passing through star wheel 200. The head of screw 210 is sized larger than the diameter of bore 208 so that by threadably engaging screw 210 in aperture 212 after shaft 206 has been inserted into aperture 208, star wheel 200 is rotatably coupled to chassis 16'. Obviously other rotatable coupling arrangements could be utilized. For example, star wheel 200 could be rotatably secured on a shaft extending perpendicularly from the inside of chassis sidewall 24'.

In order to reliably and consistently dampen the rotation of star wheel 200 and thereby absorb kinetic energy of a falling roll, shaft 206 is preferably covered with a highly viscous, high shear, motion control grease (e.g., Nyogel marketed by Nye, Inc. of New Bedford, Mass.). Obviously, other means, e.g., geared fly wheel devices or frictional devices could be used to impart rotational resistance to star wheel 200 for slowing the fall of a roll. Furthermore, it will be apparent that various other types of rotational members could be used for slowing a falling roll, and that means other than a rotational device could be used to contact and thereby slow the fall of a roll. The viscously dampened star wheel arrangement of the present invention is particularly advantageous due to its simplicity, automatic resetability and ability to consistently and reliably provide an ideal level of dampening (rotational resistance) for slowing but not stopping a falling roll.

Modified dispenser 10' also differs from dispenser 10 by the inclusion in the former of a cam 213 which is rotatable into a position for jamming gauging roll 86 against rotation, whereby gauging roll 86 becomes a fixed friction element impeding somewhat the unwinding of paper from the dispensing roll and thereby discouraging users from dispensing an excessive amount of paper. Furthermore, modified dispenser 10' utilizes a snap-lock connector arrangement 214 instead of a magnet latch for releasably securing door 50' in its closed position. In particular, when door 50' is moved to its closed position by wiping contact with lower end 108 of cover 18, spring detents 216 provided on opposite sides of door 50' are funneled into corresponding v-grooves 218 provided in lower portions of chassis sidewalls 24' and 26'. Spring detents 216 ride out of v-grooves 218 to release door 50' when door 50' is contacted by cover lower end 108 as closure cover 18 is moved to its fully open position. This arrangement provides greater securing strength than does the magnetic latch arrangement of the first embodiment, whereby there is less chance that door 50' will inadvertently open.

While particular embodiments of the invention have been shown and described, it is recognized that various modifications thereof will occur to those skilled in the art. Therefore, the scope of the herein-described invention shall be limited solely by the claims appended hereto.

We claim:

1. A dispenser for dispensing sheet material from a first roll and retaining therein at least one reserve roll from which sheet material may be dispensed when said first roll is depleted, comprising:

a chassis; and dispensing roll transfer means attached to said chassis for transferring a roll to a dispensing position where dispensing from the roll will begin, said transfer means comprising:

guiding means for guiding the roll along a pathway to said dispensing position as it falls under the force of gravity; and fall retarding means positioned in said pathway above said dispensing position for retarding the fall of said roll into said dispensing position.

2. A dispenser according to claim 1, wherein said fall retarding means comprises a rotatable member positioned to be contacted and rotated by the roll falling along said pathway, whereby the fall of the roll is retarded by rotational resistance of the rotatable member.

3. A dispenser according to claim 2, wherein said rotatable member comprises dampening means for dampening the rotation of said rotatable member.

4. A dispenser according to claim 3, wherein said rotatable member is connected to said chassis by a rotatable coupling and said dampening means comprises a high-shear motion control grease applied to said rotatable coupling.

5. A dispenser according to claim 3, wherein said rotatable member comprises a star-wheel having a plurality of substantially radially extending spokes, said star-wheel being rotationally mounted with respect to said pathway such that the falling roll will contact one of said spokes protruding into said passageway and cause said rotational member to rotate until the protruding spoke moves out of said passageway allowing the falling roll to pass by said rotational member and into the dispensing position at a reduced speed.

6. A dispenser according to claim 5, wherein said star wheel has five substantially radially extending spokes.

7. A dispenser according to claim 5, wherein said star wheel is connected to said chassis by a rotatable coupling and said dampening means comprises a high shear motion control grease applied to said coupling.

8. A dispenser according to claim 7, wherein said rotatable coupling comprises a shaft of said star wheel, and a correspondingly sized aperture in said chassis for receiving said shaft.

9. A dispenser according to claim 5, wherein said rotatable member is positioned such that the falling roll is no more than ½ inch above the dispensing position when it just passes the rotatable member.

10. A dispenser for dispensing sheet material from a first roll retaining therein at least one reserve roll from which sheet material may be dispensed when said first roll is depleted, comprising:

a chassis; and a dispensing roll transfer structure attached to said chassis, said transfer structure comprising:

opposed guide channels formed on opposite sides of said chassis operative to receive axial ends of said first roll in a sheet dispensing position where dispensing from the roll will begin and a second dispensing roll in a reserve position thereabove, both said dispensing rolls being movable by gravity downwardly in said guide channels; and a rotatable member positioned above said sheet dispensing position to be contacted and rotated by an axial end of a roll moving downwardly between said guide channels, whereby downward movement of the roll toward the dispensing position is retarded by rotational resistance of the rotatable member.

11. A dispenser according to claim 10, wherein said rotatable member comprises dampening means for dampening the rotation of said rotatable member.

12. A dispenser according to claim 11, wherein said rotatable member is connected to said chassis by a rotatable coupling and said dampening means comprises a high-shear motion control grease applied to said rotatable coupling.

13. A dispenser according to claim 11, wherein said rotatable member comprises a star-wheel having a plurality of substantially radially extending spokes, said star-wheel being rotationally mounted with respect to said guide channels such that the axial end of the roll moving downwardly therebetween will contact one of said spokes protruding into one of said guide channels and cause said rotational member to rotate until the protruding spoke moves out of said guide channel allowing the downwardly moving roll to pass by said rotational member and into the dispensing position at a reduced speed.

14. A dispenser according to claim 13, wherein said star wheel has five substantially radially extending spokes.

15. A dispenser according to claim 13, wherein said star wheel is connected to said chassis by a rotatable coupling and said dampening means comprises a high shear motion control grease applied to said coupling.

16. A dispenser according to claim 15, wherein said rotatable coupling comprises a shaft of said star wheel, and a correspondingly sized aperture in said chassis for receiving said shaft.

17. A dispenser according to claim 13, wherein said rotatable member is positioned such that the downwardly moving roll is no more than ½ inch above the dispensing position when it just passes the rotatable member.

18. A dispenser for dispensing sheet material from a plurality of dispensing rolls of sheet material having spindle means extending beyond opposite ends thereof, comprising:

a chassis having a sheet dispensing opening in one face thereof;

a dispensing roll transfer structure including:

mutually spaced guide track members forming substantially vertically extending, open ended guide channels on opposite sides of the chassis for reception of said spindle means and for gravitationally induced guided movement of a roll between said guide channels from an elevated reserve position to a sub-adjacent sheet-dispensing position where dispensing from the roll will begin; and a rotatable member positioned above said sheet dispensing position to be contacted and rotated by a spindle means of a roll moving downwardly between said guide channels, whereby downward movement of the roll toward the sheet-dispensing position is retarded by rotational resistance of the rotatable member; and a gauging roll journalled for rotation between opposite sides of said chassis and arranged to (1) vertically support a dispensing roll in said sheet-dispensing position and locate the spindle means thereof in said guide channels for so long as said supported dispensing roll is not depleted of sheet material, and (2) allow passage of said spindle means from lower open ends of said guide channels when the supported dispensing roll becomes depleted of sheet material;

wherein at least one of said guide track member is mounted for pivotal movement to place an upper end thereof in (1) a position of subadjacent vertically supporting engagement with a spindle means of a dispensing roll in said reserve position when said spindle means of said dispensing roll is retained in said sheet dispensing position by said gauging roll, and (2) a release position displaced from said position of engagement when said spindle means of said dispensing roll moves by gravity from said sheet dispensing position to fall from the open lower ends of said guide channels.

19. A dispenser according to claim 18, wherein said chassis contains a compartment beneath the lower ends of said guide channels for receiving residual portions of dissipated dispensing rolls; a door operably connected to said chassis for releasably closing said compartment; and releasable latch means operable for holding said door in its compartment-closing condition and for opening said door for removal of said residual roll portions.

20. A dispenser according to claim 18, wherein said rotatable member comprises dampening means for dampening the rotation of said rotatable member.

21. A dispenser according to claim 20, wherein said rotatable member is connected to said chassis by a rotatable coupling and said dampening means comprises a high-shear motion control grease applied to said rotatable coupling.

22. A dispenser according to claim 21, wherein one of said guide track members is interrupted to form upper and lower guide track segments, and said rotational member is positioned between said upper and lower guide track segments.

23. A dispenser according to claim 20, wherein said rotatable member comprises a star-wheel having a plurality of substantially radially extending spokes, said star-wheel being rotationally mounted with respect to one of the guide channels such that the spindle means moving downwardly therein will contact one of said spokes protruding into said one guide channel and cause said rotational member to rotate until the protruding spoke moves out of said guide channel allowing the downwardly moving roll to pass by said rotational member and into the sheet dispensing position at a reduced speed.

24. A dispenser according to claim 23, wherein said star wheel has five substantially radially extending spokes.

25. A dispenser according to claim 23, wherein said star wheel is connected to said chassis by a rotatable coupling and said dampening means comprises a high shear motion control grease applied to said coupling.

26. A dispenser according to claim 25, wherein said rotatable coupling comprises a shaft of said rotational member extending outwardly from said star wheel, and a correspondingly sized aperture in said chassis for receiving said shaft.

27. A dispenser according to claim 23, wherein said rotatable member is positioned such that the downwardly moving roll is no more than ½ inch above the sheet dispensing position when it just passes the rotatable member.

* * * * *